United States Patent [19]

Okabe

[11] 4,191,104

[45] Mar. 4, 1980

[54] PRINTER HAVING SWINGABLE PRINTING CHARACTER SUPPORTING ENDLESS BELTS

[75] Inventor: Katsuhiko Okabe, Tokorozawa, Japan

[73] Assignee: Copal Company Limited, Tokyo, Japan

[21] Appl. No.: 862,831

[22] Filed: Dec. 21, 1977

[30] Foreign Application Priority Data

| | | | |
|---|---|---|---|
| Dec. 24, 1976 | [JP] | Japan | 51-157184 |
| Dec. 24, 1976 | [JP] | Japan | 51-157185 |
| Dec. 27, 1976 | [JP] | Japan | 51-178164[U] |

[51] Int. Cl.[2] ..... B41J 1/20

[52] U.S. Cl. ..... 101/93.14; 400/146

[58] Field of Search ..... 101/111, 93.14; 400/146

[56] References Cited

U.S. PATENT DOCUMENTS

| | | | |
|---|---|---|---|
| 2,901,540 | 8/1959 | Canepa | 101/111 X |
| 3,115,092 | 12/1963 | Sasaki | 101/111 X |
| 3,766,852 | 10/1973 | DePuy et al. | 101/111 X |
| 3,793,951 | 2/1974 | Denley | 101/111 |
| 3,983,804 | 10/1976 | Thienemann | 101/111 X |
| 4,075,945 | 2/1978 | Bienholz | 101/111 |

*Primary Examiner*—Edward M. Coven

*Attorney, Agent, or Firm*—J. Harold Nissen

[57] ABSTRACT

A printer having a plurality of swingable and rotatable printing character bearing endless belts each of which is stretched around a pair of rotatable wheels, one of which is adapted to be swung into contact with a platen. The other wheel is adapted to be driven by a driving shaft to select the character to be printed. The belts are selectively swung in response to a signal from a control circuit to abut the characters selected against the platen onto a paper therebetween, and the belts are also selectively moved by the other wheels in response to electrical signals which drive a drive shaft which drives the other wheels.

4 Claims, 6 Drawing Figures

PRINTER HAVING SWINGABLE PRINTING CHARACTER SUPPORTING ENDLESS BELTS

BACKGROUND OF THE INVENTION

The present invention relates to a printer having a plurality of individually swingable printing character bearing belts cooperating with a platen for printing a line of printing of desired characters on a paper by selectively swinging the printing belts upon issuance of printing signals from a control circuit of the printer so as to cause the belts to abut against the platen with the paper held therebetween after selection of a desired character on each printing belt during the rotation thereof around a pair of wheels stretching each belt therearound.

Different from the prior art printer of the type having a plurality of individually swingable printing rings for each figure or number, for example, which are selectively abutted against a platen when a selected character is positioned at a printing position on each printing ring for the printing operation, the printer of the present invention provides a respective printing belt which is stretched around a pair of wheels supported by a wheel supporting swingable lever with one of the wheels driven by a driving shaft for rotation of the belt so as to select a desired character on the belt while the other wheel is adapted to move against a platen when a desired character is selected by the swinging of the wheel supporting lever for effecting the printing on a paper held therebetween. The swinging of each wheel supporting lever is controlled by a driving lever which is in turn controlled by a select lever and an electromagnet cooperating therewith and actuated by a printing signal from the control circuit of the printer while the driving shaft continues to rotate thereby permitting printing of a line of the desired characters on a paper in cooperation with the platen, and, after completion of the printing operation, the respective printing belt is returned by a spring so as to restore the belt to its initial position when the driving lever is returned to its initial position through a reset cam driven by the driving shaft and moving it to the initial position in readiness for the next printing operation.

Since the prior art printer having a plurality of printing rings is very complicated in construction and troublesome in assembly requiring the preparation of two kinds of materials for constructing the printing rings having resilient nature of each printing character for permitting the clear printing. Further, the printing rings have disadvantages in that the number of printing characters to be born thereon is limited.

The present invention aims at avoiding the above described disadvantages of the prior art printer.

The above object is achieved in accordance with the present invention by providing a printer having a plurality of swingable and rotatable printing character bearing endless belts cooperating with a platen for the printing operation, characterized by a swingable supporting member for supporting each of the printing belts so as to rotate the printing belt around itself on the supporting member, a driving shaft for transmitting the driving force to the respective printing belt for the rotation thereof around itself, one of the plurality of printing characters born on the periphery each of the printing belt being selected for the desired printing operation by virtue of the rotation of the printing belt around itself while the printing belt is swung toward the platen for effecting the printing operation by virtue of the swinging movement of the supporting member, signal emitting means rotated in synchronism with the driving shaft, signal receiving means cooperating with the signal emitting means so as to issue an electrical signal each time one cycle of the printing operation is effected by the rotation of the driving shaft, the electrical signal being applied to a control circuit for controlling the starting and stopping of the operation of the printer, a detecting disc rotated in synchronism with the driving shaft and provided with a plurality of slits around the rotational axis thereof corresponding in number to that of the characters on the respective printing belt and a detecting device cooperating with the slits in said detecting disc for issuing character synchronizing timing signals in timed relationship to the positions of the respective moving characters on each printing belt as it rotates around itself, the timing signals being applied to the control circuit for permitting a desired character of the plurality of characters on each printing belt to be selected for the printing operation during the rotation of the respective printing belt.

The starting and terminating of one cycle of printing operation may be controlled by a magnet adapted to be rotated by one revolution by the driving shaft for one cycle of the printing operation and a detecting reed switch cooperating therewith so as to issue an electrical signal applied to the control circuit.

The character selecting and synchronizing signal may be obtained by the provision of a detecting disc having circumferentially arranged slits corresponding in number to that of the characters and rotated by the driving shaft and a detecting device cooperating with the slits so that signals corresponding to the positions of the characters on the respective printing belt are obtained which are applied to the control circuit so as to control the selection of a desired character on the respective printing belt.

DETAILED DESCRIPTION OF THE PREFERRED EMBODIMENTS

Figure 1:
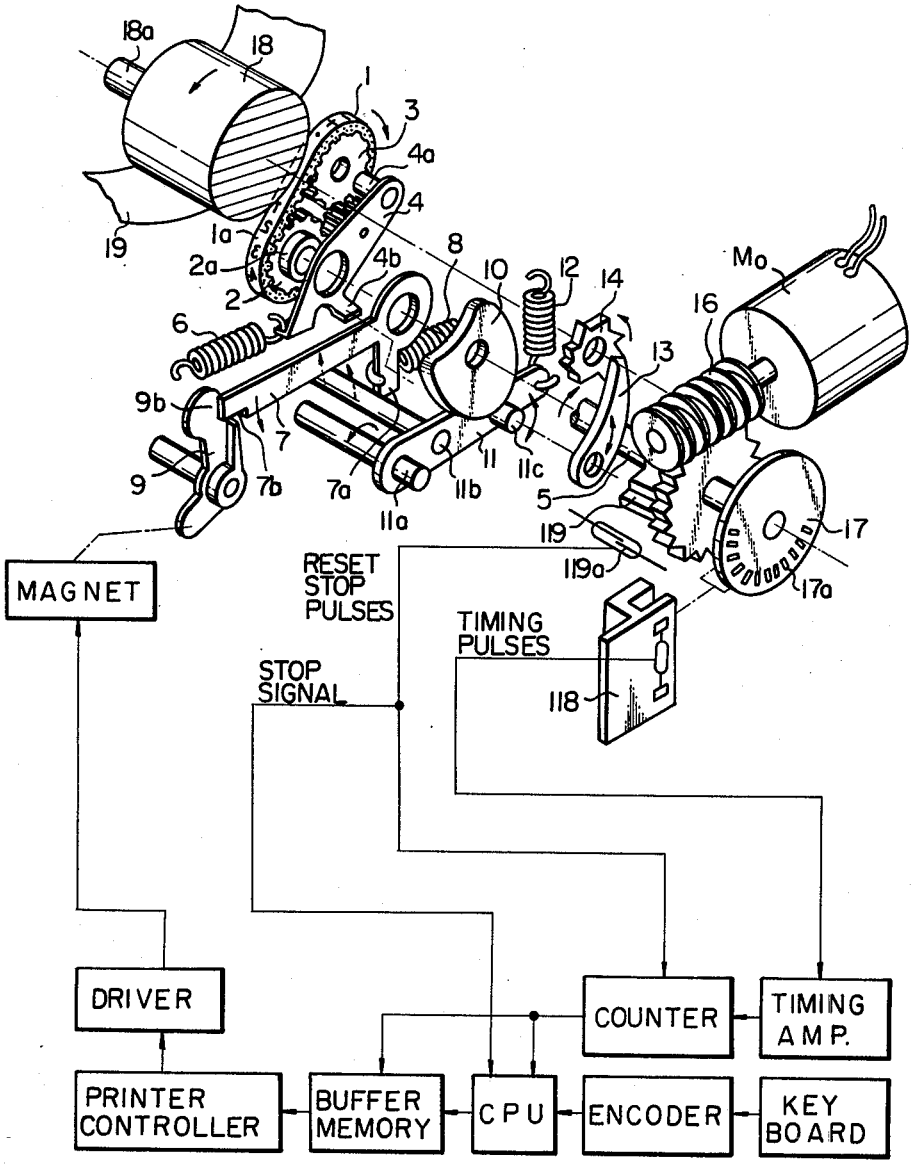
FIG. 1 is an exploded perspective view showing the main portions of an embodiment of the printer constructed in accordance with the present invention.

Referring to FIG. 1, a plurality of printing character bearing belts 1 are arranged in jaxtaposed relationship adjacent to each other (only one belt 1 being shown in the drawing). Each printing belt 1 bears on at least a portion of the periphery thereof a series of printing characters 1*a* and is stretched around a pair of wheels 2 and 3 so as to be rotated around itself when either of the wheels 2, 3 is rotated. Each wheel 2, 3 is rotatably supported by a swingable printing belt supporting lever 4, the wheel 3 being rotatably supported by a shaft 4*a* secured to the lever 4.

A driving shaft 5 is provided which is driven by a driving motor MO through a worm 16 secured to the shaft of the motor MO and a worm wheel secured to the driving shaft 5 and engaging with the worm 16. The respective wheel 2 has a boss 2*a* secured to the driving shaft 5 so as to be rotated about its axis while each printing belt supporting lever 4 is swingably supported on the boss 2*a* of the wheel 2 secured to the driving shaft 5 so that the respective printing belt 1 can be reciprocally moved toward and away from a platen 18 located in parallel adjacent to the respective printing belt 1 along an orbital path around the driving shaft 5 so that the wheel 3 is adapted to abut against the platen 18 with the belt 1 held therebetween.

The platen 18 is secured to a rotatable shaft 18*a* so that the platen 18 is rotated together with the shaft 18*a* when the latter is rotated.

Each printing belt supporting lever 4 is provided with a bent portion to which one end of a spring 6 is attached while the other end of the spring 6 is attached to the machine frame of the printer so that the respective printing belt supporting lever 4 is urged by the spring 6 in the clockwise direction tending to move the respective printing belt 1 away from the platen 18.

Each printing belt supporting lever 4 is also provided with another bent portion 4*b* the function of which will be described later.

A plurality of swingable driving levers 7 are provided and each driving lever 7 is swingably supported on the boss 2*a* of the wheel 2 and is provided with a substantially downwardly extending arm 7*a* adapted to engage with the bent portion 4*b* of the respective printing belt supporting lever 4 and a substantially horizontally extending arm having an arresting notch 7*b* formed at its tip. One end of a spring 8 is secured to the arm 7*a* while the other end of the spring 8 is secured to the machine frame of the printer so that the respective driving lever 7 is urged in the counterclockwise direction by the spring 8 thereby urging the printing belt supporting lever 4 in the same direction against the action of the spring 6 by virtue of the engagement of the arm 7*a* with the bent portion 4*b* of the lever 4.

The respective driving lever 7 is, however, normally arrested by a select lever 9 to be described later at a position at which the respective printing belt supporting lever 4 is held so as to maintain the printing belt 1 thereon apart from the platen 18.

To this end, the respective select lever 9 is pivotally supported by a shaft and the upwardly extending arm 9*b* of the lever 9 has at its upper end an arresting shoulder which is releasably engaged with the arresting notch 7*b* of the respective driving lever 7 so as to maintain the driving lever 7 at the above described position maintaining the printing belt 1 apart from the platen 18.

The respective select lever 9 is connected to an electromagnet to be described later so that the lever 9 is controlled by a control circuit for the desired printing operation.

Referring to FIG. 1, a reset lever 11 is swingably supported by a shaft 11*a* extending in parallel to the driving shaft 5 beneath the horizontally extending arm of each driving lever 7. The shaft 11*a* is spaced a certain distance from the horizontally extending arm of each driving lever 7 when the driving lever 7 is arrested by the select lever 9. Thus, when the respective driving lever 7 is released from the select lever 9 and is swung in the counterclockwise direction by the action of the spring 8 thereby urging the respective printing belt supporting lever 4 in the same direction so as to move the printing belt 1 thereon toward the platen 18, the driving lever 7 is arrested by the shaft 11*a* before the printing belt 1 abuts against the platen 18 and the printing belt supporting lever 4 is further swung together with the printing belt 1 thereon by the inertia thereof against the action of the spring 6 until the printing belt 1 abuts against the platen 18 for printing a selected character 1*a* on the respective printing belt 1 on a paper 19 sandwiched therebetween as described later, and, after the abutment, the printing belt supporting lever 4 is swung back by the action of the spring 6 so as to be held by the driving lever 7 which has been arrested by the shaft 11*a* thereby clearing the printing belt 1 from the paper 19 to prevent the quality of printing on the paper 19 from being deteriorated.

Turning now to the description of the reset lever 11 per se, the lever 11 extends beneath the driving shaft 5 and is urged by a spring 12 in the counterclockwise direction and a cam follower shaft 11*c* secured to the lever 11 cooperates with a reset cam 10 secured to the driving shaft 5 so that the reset lever 11 is reciprocally swung up and down as the cam 10 is rotated by the driving shaft 5. A reset shaft 11*b* is secured to the reset lever 11 extending beneath the respective driving lever 7.

The reset cam 10 is so configured with respect to the cam follower shaft 11*c* of the reset lever 11 that, when the driving shaft 5 begins to rotate at the beginning of one cycle of printing operation, the cam 10 urges the reset lever 11 downwardly so as to move the reset shaft 11*b* apart from the respective driving lever 7 thereby permitting the driving lever 7 to be swung in the counterclockwise direction after the same is released from the select lever 9 until arrested by the shaft 11*a*, the printing belt supporting lever 4 being further swung for effecting printing operation as described above, but the reset lever 11 is swung upwardly at the end of one cycle of printing operation by the engagement of the cam follower shaft 11*c* with recessed portion of the cam 10 as it rotates so that the reset shaft 11*b* is moved upwardly to urge upwardly the respective driving lever 7 which has been held by the shaft 11*a* after releasing thereof from the select lever 9 so that the respective driving lever 7 is again arrested by the respective select lever 9 which has restored its position ready for arresting the driving lever 7 as shown in FIG. 1 by the deenergization of the electromagnet, the respective printing belt supporting lever 4 being returned to its initial position by the action of the spring 6 and maintaining the printing belt 1 apart from the platen 18.

In order to feed the paper 19 after completion of each cycle of the printing operation, a ratchet 14 is secured to the rotatable shaft 18*a* of the platen 18 and a claw lever 13 having a claw portion engaging with the ratchet 14 is pivotally supported by the cam follower shaft 11*c* or another shaft (not shown) secured to the reset lever 11. In order to insure the engagement of the claw portion of the claw lever 13 with the ratchet 14, a spring (not shown) is provided to urge the claw lever 13 toward the ratchet 14.

Thus, when the reset lever 11 is swung upwardly for effecting the resetting of the respective driving lever 7 at the end of each cycle of printing operation as described above, the claw lever 13 is moved upwardly to rotate the ratchet 14 so that the rotatable shaft 18*a* is rotated together with the platen 18 thereby permitting the paper 19 located around the platen 18 to be fed so as to be ready for the next printing operation.

In order to prevent the ratchet 14 from turning in a reverse direction and insure positive feeding of the paper 19, a stopper claw (not shown) cooperating with the ratchet 14 may be provided.

In order to control the starting and stopping of one cycle of printing operation of the printer by a control circuit, a magnet 119 is provided which is mounted on the driving shaft 5 so as to be rotated together with the shaft 5 and a reed switch 119*a* is located adjacent to the path of movement of the magnet 119 so that a pulse is generated each time the magnet 119 moves across the reed switch 119*a* as the driving shaft 5 rotates. The pulse is applied to the control circuit so as to control the start and stop of the operation of the printer.

In order to select a desired character from the plurality of characters 1*a* of the respective printing belt 1 for the printing operation in timed relationship to the selective releasing of the respective driving lever 7 from the select lever 9 thereof by the actuation of the respective electromagnet, a detecting disc 17 is secured to the driving shaft 5. The detecting disc 17 is provided with a series of slits 17*a* arranged equally spaced from each other along the periphery of the disc 17, and the number of the slits 17*a* corresponds to that of the characters 1*a* on each printing belt 1 so that the angular phase between the adjacent two slits 17*a* corresponds to the pitch formed between the adjacent two characters 1*a* on each printing belt 1. A detecting device 118 is provided straddling the periphery of the disc 17 and the detecting device 118 cooperates with the slits 17*a* of the disc 17 so that a character synchronizing timing pulse is produced each time one slit 17*a* moves across the detecting device 118 as the driving shaft 5 rotates. The phase of each synchronizing timing pulse is slightly in advance of the passage of each character 1*a* across a predetermined printing position in the printer at which the printing belt 1 abuts against the platen 18 so as to compensate for the time lag caused by the mechanical actuation of each electromagnet after it is energized and the time period required for the orbital movement of the respective printing belt 1 around the driving shaft 5 for the printing operation. The character synchronizing timing pulses are applied to the control circuit for controlling the selective actuation of the respective printing belt 1 and the select lever 9 coupled therewith.

The control circuit applicable to the printer of the present invention comprises a key board, a key encoder, a CPU, an output buffer memory, a printer controller, a timing amplifier, a counter and driver transistors connected as shown in FIG. 1.

The timing amplifier receives the character synchronizing timing pulses issued from the detecting device 118. The counter which receives the timing pulses from the timing amplifier also receives a reset stop signal from the reed switch 119*a* so as to seek the starting position of the operation of the printer to reset the counter and apply a stop signal to CPU in each printing operation.

Upon manipulation of the key board, the encoder usually comprising a diode matrix encodes the input from the key board and applies the output thereof to the CPU for the operation thereof with the output of the counter being input to the CPU. The buffer memory receiving the output of the CPU and the counter stores the data for the printing operation maintaining the timed relationship to the actuation of the mechanical elements of the printer. The printer controller receiving the data from the buffer memory converts the data into printer driving signals which are supplied through the driver transistors to the driving motor MO for driving the driving shaft 5 and the respective electromagnet actuating the select lever 9 for moving the respective printing belt 1 toward the platen 18 and for selection of the desired character 1*a* on the respective printing belt 1 during the rotation thereof in synchronized relationship therebetween.

The operation of the control circuit per se is not the subject matter of the present invention, and, therefore, a detailed description thereof is omitted.

Figure 2:
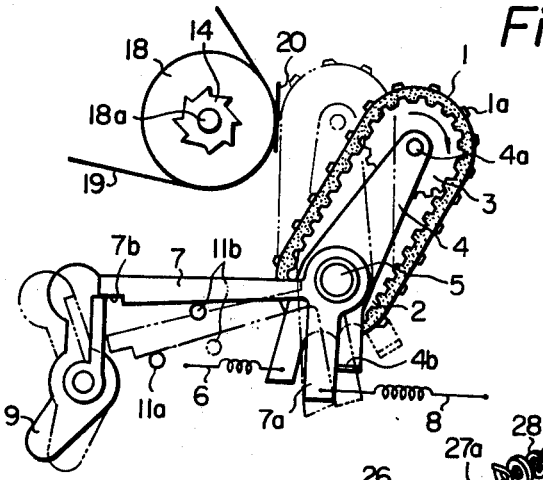
FIG. 2 is a schematic sectional side view showing the embodiment of FIG. 1.

Upon issuance of a printing demand from the control circuit, the driving motor MO is energized to drive the driving shaft 5 in the direction indicated by the arrow through the worm 16 and the worm wheel secured to the driving shaft 5 and engaging with the worm 16. The respective printing belt 1 is then rotated in the direction indicated by the arrow through the wheel 2. At this time, each printing belt 1 is held apart from the platen 18 as shown in FIGS. 1 and 2 due to the fact that the respective driving lever 7 is arrested by the select lever 9 so that each printing belt 1 is permitted to swing in the clockwise direction by the action of the spring 6.

At the beginning of the rotation of the driving shaft 5, the reset cam 10 urges the reset lever 11 downwardly so that the reset shaft 11*b* is moved apart from the respective driving lever 7 thereby permitting the latter to be swung in the counterclockwise direction until abutting against the shaft 11*a* upon releasing thereof from the select lever 9.

The character synchronizing timing pulses are generated by the rotation of the detecting disc 17 cooperating with the detecting device 118.

The phases of the timing pulses are in advance to the respective corresponding positions of the characters 1*a* on the respective rotating printing belts 1 in order to exactly match the timing of the abutment of each printing belt 1 against the platen 18 after the actuation of the respective electromagnet for releasing each select lever 9 for the orbital movement of the printing belt 1 with the timing of positioning of a desired character 1*a* of each printing belt 1 at the printing position during the rotation of each printing belt 1 with the time lag of actuation of the mechanical elements of the electromagnet after energization thereof being compensated for.

In case the character "0" is to be selected for the printing operation, when the printing input signal from the key board is generated in synchronized relation to the character synchronizing timing pulses corresponding to the character "0", the electromagnet corresponding to the character "0" is instantaneously energized through the control circuit of the printer thereby releasing the select lever 9 from the driving lever 7 corresponding to the character "0".

Thus, the driving lever 7 is swung in the counterclockwise direction by the spring 8 to urge the printing belt supporting lever 4 in the same direction to move the printing belt 1 in orbital path around the wheel 2 and to abut the printing belt 1 against the platen 18, while the printing belt 1 per se has been rotated for positioning the character "0" at the printing position when the printing belt 1 abuts against the platen 18, thereby permitting the character "0" to be printed on the paper 19 sandwiched between the platen 18 and the printing belt 1.

In this case, the driving lever 7 is arrested by the shaft 11*a*, and the printing belt supporting lever 4 is swung further apart from the driving lever 7 by the inertia thereof to cause the printing belt 1 to abut against the platen 18 for printing operation leaving a clearance between the bent portion 4b of the printing belt supporting lever 4 and the arm 7a of the driving lever 7 and, after the abutment, the printing belt supporting lever 4 is swung back by the spring 6 and is arrested with its bent portion 4b by the arm 7a of the driving lever 7 so that the printing belt 1 is held apart from the platen 18 by a clearance corresponding to the clearance as described above so as to clear the printing belt 1 from the paper 19.

The same applies to the case in which a character other than "0" is to be printed.

At the end of one revolution of the driving shaft 5, the cam follower shaft 11c of the reset lever 11 engages with the recessed portion of the reset cam 10 so that the reset lever 11 is swung upwardly by the spring 12 so that the reset shaft 11b urges the respective driving lever 7 in the clockwise direction together with the printing belt 1 whereby the respective driving lever 7 is arrested by the select lever 9 which has restored its arresting position by the deenergization of the electromagnet. Thus, the printer is reset for the next printing operation.

The paper feeding operation is as follows.

At the beginning of one cycle of the printing operation, the claw lever 13 is lowered by the clockwise swinging movement of the reset lever 11 so that the claw portion of the lever 13 slides downwardly over the tooth of the ratchet 14, and, at the end of one revolution of the driving shaft 5, the reset lever 11 is swung in the counterclockwise direction as described previously, so that the claw lever 13 is moved upwardly thereby rotating the ratchet 14 in the counterclockwise direction by the engagement of the claw portion of the lever 13 with the ratchet 14 so as to feed the paper 19 located around the platen 18 at the end of one cycle of the printing operation.

FIG. 2 shows the above described operation of the printing belt 1. In this case, an ink ribbon 20 is interposed between the paper 19 and the printing belt 1 and fed appropriately in the direction perpendicular to the plane of the drawing for insuring clear printing.

Figure 3:
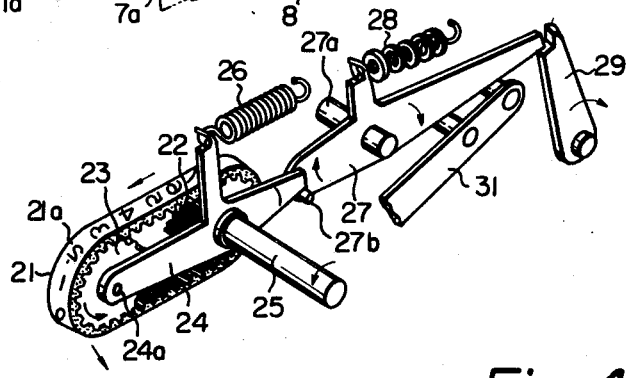
FIG. 3 is a fragmentary perspective view showing another embodiment of the present invention.
Figure 4:
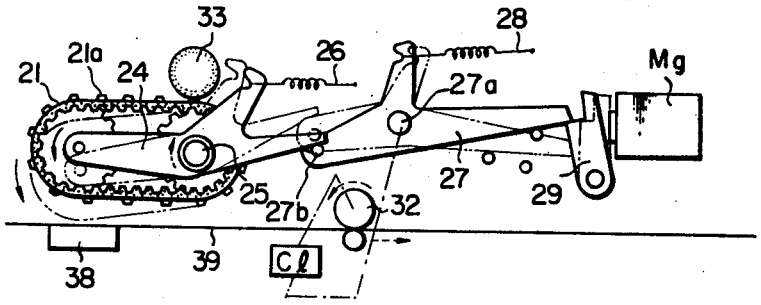
FIG. 4 is a side view of FIG. 3.

FIGS. 3 and 4 show an alternative embodiment of the present invention.

In this case, the printing belt supporting lever 24 is swingably supported by a driving shaft 25 which is adapted to rotate the printing belt 21 stretched around the wheels 22, 23 around itself in like manner as in the case of FIG. 1 and the lever 24 is urged in the clockwise direction by the spring 26. The driving lever 27 is swingably supported by a shaft 27a which is separately provided from the shaft 25. The driving lever 27 is urged in the clockwise direction by a spring 28 so as to urge the printing belt supporting lever 24 in a counterclockwise direction by the engagement of a pin 27a secured to the lever 27 with the printing belt supporting lever 24 thereby permitting the printing of a paper 39 held between the belt 21 and a platen 38 as shown in FIG. 4. As described previously, the driving lever 27 is arrested by a select lever 29 actuated by the electromagnet Mg so as to maintain the belt 21 apart from the platen 38. Thus, when the select lever 29 is released from the lever 27 by the electromagnet Mg, the above described printing operation is effected. The reset lever 31 cooperating with the driving lever 27 functions in the similar manner as in the case of the reset lever 11 shown in FIG. 1.

The paper feeding is effected by a paper feeding roller 32 which is coupled with the shaft 27a through a one-way clutch Cl which is adapted to drive the roller 32 only in the counterclockwise direction each time the shaft 27 experiences the return movement by the action of the reset lever 31.

In the embodiment of FIGS. 3 and 4, the ink is supplied to the respective printing belt 21 by means of an ink roller 33 located in contact with the printing belt 21 at the position opposite to the wheel 22 secured to the driving shaft 25 thereby permitting the ink to be at all times applied to the respective printing belt 21.

Figure 5:
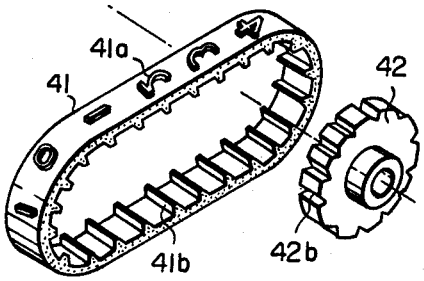
FIGS. 5 and 6 are exploded perspective views showing several embodiments of the printing character bearing belt of the present invention.

FIG. 5 shows the driving engagement of the recesses 42b of the wheel 42 (secured to the driving shaft) with the teeth 41b of the printing belt 41 having the printing characters 41a.

Figure 6:
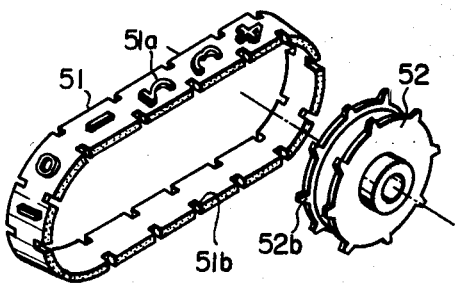

FIG. 6 shows an alternative driving engagement of the teeth 52b of the sprocket wheel 52 (driven by the driving shaft) with the corresponding recesses 51b formed at both edges of the printing belt 51 having the printing characters 51a.

It is apparent that the respective printing belt may be driven by the appropriate frictional engagement with the driving wheel.

The printing characters may be separately formed from the belt and may be attached to the belt.

The respective select lever may be driven instead of spring means by cam means actuated in synchronized relation to the selection of the printing character in the respective printing belt so as to transmit the driving force from the select lever to the driving lever.

The present invention makes it possible to provide a large number of various printing characters by the provision of the printing belts instead of the printing rings incorporated in the prior art printers.

I claim:

1. Printer having a plurality of swingable and rotatable printing character bearing endless belts cooperating with a platen for the printing operation, wherein the improvement comprises:

a swingable supporting member for supporting each said printing belt so as to rotate said printing belt around itself on said supporting member;

a driving shaft for transmitting the driving force to the respective printing belt for the rotation thereof around itself, one of the plurality of printing characters born on the periphery of each of said printing belt being selected for the desired printing operation by virtue of the rotation of said printing belt around itself while said printing belt is swung toward said platen for effecting the printing operation by virtue of the swinging movement of said supporting member;

signal emitting means rotated in synchronism with said driving shaft;

signal receiving means cooperating with said signal emitting means so as to issue an electrical signal each time one cycle of the printing operation is effected by the rotation of said driving shaft, said electrical signal being applied to a control circuit for controlling the starting and stopping of the operation of said printer;

a detecting disc rotated in synchronism with said driving shaft and provided with a plurality of slits around the rotational axis thereof corresponding in number to that of the characters on the respective printing belt;

a detecting device cooperating with said slits in said detecting disc for issuing character synchronizing timing signals in timed relationship to the positions of the respective moving characters on each printing belt as it rotates around itself, said timing signals being applied to said control circuit for permitting a desired character of said plurality of characters on each printing belt to be selected for the printing operation during the rotation of the respective printing belt;

a driving member for swinging said supporting member toward said platen until shortly before the abutment of said belt on said supporting member against said platen, each said driving member cooperating with a select member adapted to be actuated to release said driving member for the driving of said supporting member upon issuance of a printing signal from said control circuit, said supporting member being further swung by the inertia thereof after disengagement from said driving member to cause said belt to abut against said platen for the printing operation, said supporting member being immediately returned by virtue of a spring cooperating with said supporting member so as to swing said belt apart from said platen;

stopper means for limiting the swinging movement of each said driving member to a position whereby said supporting member is swung further by virtue of the inertia thereof against the action of said spring after said driving member is stopped by said stopper means thereby permitting said printing belt to abut against said platen for the printing operation while the respective supporting member is swung back by said spring thereof after the abutment of said printing belt thereof against said platen so as to be held by said driving means which is held at said stopped position by said stopper means thereby clearing said printing belt from said platen; and, reset means engageable with said stopper means and actuated in synchronism with the rotation of said driving shaft so as to cause each driving member to be swung back so that the respective driving member is arrested by said select member thereof so as to allow each printing belt to return to its initial position by the swinging of said supporting member by its spring.

2. Printer according to claim 1, wherein;

said reset means comprises cam means rotated by said driving shaft and engaged with said stopper means so that the respective driving member is swung back by said cam means through said stopper means so as to be arrested by said select member.

3. Printer according to claim 2, wherein the improvement further comprises:

a rotatable shaft fixedly securing said platen thereon so as to rotate the same therewith, a ratchet wheel secured to said rotatable shaft, a claw lever swingably supported by a pin secured to said stopper means, said claw lever having a claw cooperating with said ratchet wheel, and said claw lever being urged toward said ratchet wheel by a spring so as to engage said claw with said ratchet wheel thereby permitting said rotatable shaft of said platen to be stepwise rotated together with said platen by the engagement of said claw lever with said ratchet wheel so as to feed a paper located around said platen.

4. Printer according to claim 1 wherein the improvement further comprises:

a rotatable shaft fixedly securing said platen thereon so as to rotate the same therewith, a ratchet wheel secured to said rotatable shaft, a claw lever swingably supported by a pin secured to said stopper means, said claw lever having a claw cooperating with said ratchet wheel, and said claw lever being urged toward said ratchet wheel by a spring so as to engage said claw with said ratchet wheel thereby permitting said rotatable shaft of said platen to be stepwise rotated together with said platen by the engagement of said claw lever with said ratchet wheel so as to feed a paper located around said platen.

* * * * *